United States Patent [19]

Roseberg

[11] 4,027,812

[45] June 7, 1977

[54] CLOTHING HANGER

[76] Inventor: Harry G. Roseberg, 3101 S. Barrington, Los Angeles, Calif. 90066

[22] Filed: Apr. 2, 1976

[21] Appl. No.: 673,091

[52] U.S. Cl. ..... 223/96

[51] Int. Cl.[2] ..... A47J 51/14

[58] Field of Search ..... 223/91, 93, 96, 92; 211/89, 124; 24/134 E; 294/116

[56] References Cited

UNITED STATES PATENTS

| | | | |
|---|---|---|---|
| 1,022,295 | 4/1912 | Bowman | 223/96 |
| 1,955,792 | 4/1934 | Deknatel | 223/96 |
| 1,959,840 | 5/1934 | Peirce | 223/96 |
| 2,427,385 | 9/1947 | Chesler | 223/96 X |
| 2,581,800 | 1/1952 | Lane | 223/91 |
| 2,637,472 | 5/1953 | Lyons | 223/92 |
| 2,811,292 | 10/1957 | Neudecker et al. | 223/91 |

*Primary Examiner*—George H. Krizmanich
*Attorney, Agent, or Firm*—Poms, Smith, Lande & Glenny

[57] ABSTRACT

A clothing hanger has a pair of jaws and a pair of arms with each arm connected to a jaw. The arms are pivotally mounted relative to each other to clamp and unclamp the jaws. The arms are biased together, and a member is provided to separate the jaws against the bias. The member is a cam which is mounted for pivoting on one of the arms for camming engagement with the other arm during movement of the cam between a first position with the arms separated in the second position which allows the jaws to clamp under the bias. A cam roller is mounted on the end of the cam which engages the other of the arms to reduce friction of the cam on that arm. A stop is provided for preventing movement of the cam beyond the first position so that the cam is retained in that position. The stop sets the first position such that insertion of clothes against the cam urges the cam a sufficient distance toward the second or closed position so that the biasing force on the arms can close the jaws together. The stop is an extension of the cam which intersects a jaw when the cam is pivoted to its first position.

8 Claims, 4 Drawing Figures

CLOTHING HANGER

BACKGROUND OF THE INVENTION

This invention relates primarily to clothes hangers, especially those for slacks and skirts. More particularly, the invention relates to clamping jaw hangers. Typically, the clamping jaw hangers have a pair of jaws and an arm extending from each jaw, and the arms pivot with respect to each other to clamp or unclamp the jaws. Most hangers have a mechanism which serves to lock the jaws closed, and the jaws are either held open by the user or are biased open. The above hangers can be somewhat difficult to use. If two hands are used to hold the pants or skirt in a tight condition between the jaws, no free hand is left to close and lock the jaws. Moreover, in many of the above-described hangers, the handle includes the hanging hook. If the hanger is attempted to be opened or closed while still on the closet bar, the opening of the jaws can assume awkward orientations insofar as removing or hanging up the clothing. Oftentimes, the arms can often contact the closet bar and interfere with the opening and closing of the hanger. Therefore, the hanger must usually be removed from the closet bar.

Hangers have also been proposed which are clamped by a spring bias or the like and are opened by an internal mechanism. One of the problems with such mechanisms has been a tendency to interfere with the insertion of the clothes. However, it is also advantageous to design a hanger wherein insertion of the clothes automatically causes jaw locking. For example, in Bowman U.S. Pat. Nos. 1,022,295 and in Vigor 2,889,094, toggle mechanisms were provided between the arms. Unfortunately, there is a chance that the clothing can become pinched between the folding toggle arms. The Lasko, U.S. Pat. No. 3,606,228, hanger has a brace which falls into place to prevent the jaws from closing. However, either one jaw must be fixed to the wall or else two hands are needed to open the hanger. Cole U.S. Pat. No. 2,792,979 is similar.

SUMMARY OF THE INVENTION

The invention has as its objectives the following: to provide a clothes hanger which can be opened with one hand; to provide a hanger which can be closed on insertion of an article of clothing between the jaws; to not pinch or damage the clothes upon insertion between the jaws; and to have a handle for opening the hanger which is hinged so as not to interfere with adjacent hangers or articles of clothing. Other objects will become apparent from the following description of the invention, and it will be apparent that the above objects are met by the present invention.

Figure 1:
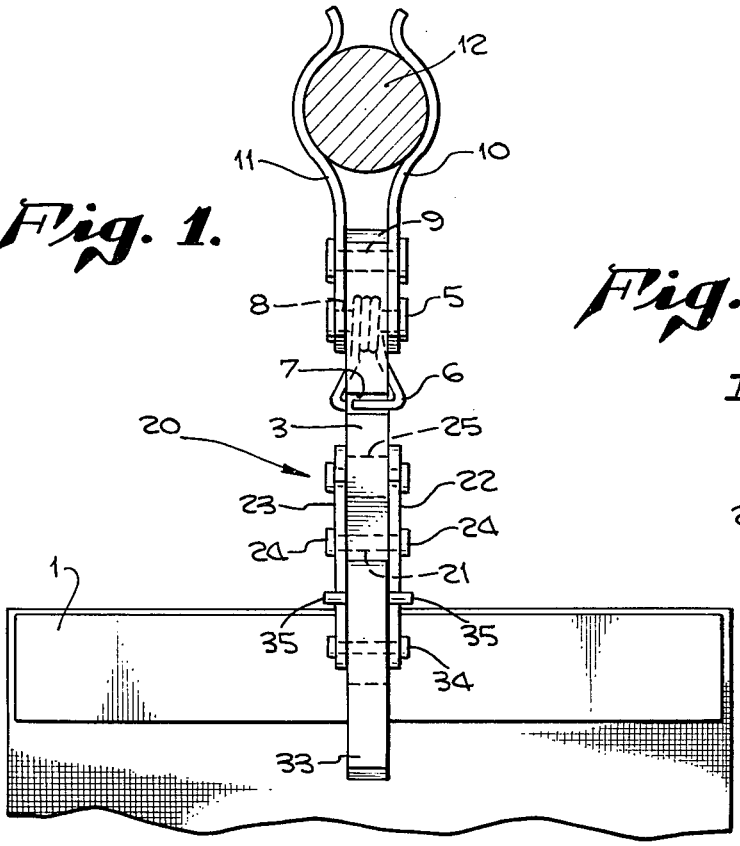
FIG. 1 shows a front elevation of the clothes hanger of the present invention.

DETAILED DESCRIPTION OF THE PREFERRED EMBODIMENT:

A clothing hanger includes a pair of jaws 1, 2 and a pair of arms 3, 4 each arm being connected to a jaw. Arms 3 and 4 are pivotally mounted relative to each other in a known manner about pivot 5. It is possible that a cross brace could be provided and arms 3 and 4 be pivoted with respect to the cross brace. Biasing means bias the jaws to their clamp position. The biasing means 6 in the exemplary embodiment is a coil spring at the pivot 5 which extends into indentations 7 on the arms and biases the arms to the closed position. (FIG. 2) The exemplary embodiment uses a pivoting and biasing system similar to that found in clothespins. The pivoting takes place around the outside of the coil spring and the sides of the spring align the arms relative to the pivot. Pin 8 which is through the coil of the spring 6 and pin 9 holds the plates 10 and 11 which resiliently holds the closet bar 12.

Figure 2:
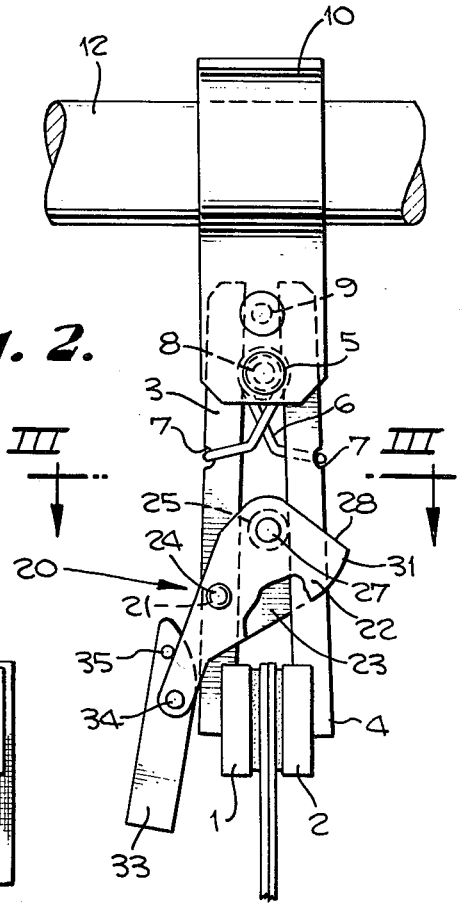
FIG. 2 shows a side elevation of the pants hanger of the present invention with the jaws in the clamped position holding an article of clothing therebetween.

Separating means are provided for opening the jaws against the biasing means, and these separating means have been improved in the present invention to provide for camming means movably mounted on one of the arms for camming engagement with the other arm during movement of the camming means between a first arm separating position and a second position allowing the biasing means to clamp the jaws. In the preferred embodiment, the camming means 20 is mounted on one of the arms 3 for camming engagement with the other arm 4 during movement of the camming means between a first arm separating position (FIG. 4) and a second position allowing the biasing means to clamp the jaws (FIG. 2). The movement of the camming means is in the form of pivoting about an axis on the arm 3. In the exemplary embodiment, the camming means 20 is mounted on a pivot 21.

The camming means may comprise a pair of camming plates and the pivot means extends through one arm for securing a camming plate on each side of that arm. In the exemplary embodiment, the camming plates 22 and 23 are mounted for pivoting movement about the pivot 21, and the flared ends 24 hold the pivot pin 21 in place and secure the camming plates 22 and 23 against arm 3. The flared ends could be rivet heads if pin 21 is a rivet, the pin and flared end could be a nut and bolt, or the arrangement could be modified to include any equivalent system. Moreover, if pivot pin 21 can be fixed to the camming plates 22 without the need of flared ends, such as by welding or threading the pins or shaft into the plates, the need for a flared member is obviated.

Cam roller means are mounted on the end of the camming means engaging the other arm to reduce friction of the camming means on that other arm during movement of the camming means between the first and second positions. The cam roller means is mounted between the camming plates. In the exemplary embodiment, the cam roller means includes a roller 25 journaled for rotation on shaft 26, and the shaft is held in place by the flared ends 27. The flared ends 27 and shaft 26 could take the many configurations of the pin 21 and flared ends 24 arrangement. Upon pivoting the camming plates 22 about the pivot 21, the cam roller 25 rolls along the arm 4. The arm 4, therefore, acts as a cam follower to pivot arm 4 about pivot 5. It is advantageous to have the cam follower surface flat. If it bowed outward from the top to the bottom, the jaws would not spread as far when the cam means reached its first position (FIG. 4), and if the arm 4 bowed inward, it may be difficult to prevent the forces from the biasing means acting on arm 4 from pivoting the camming means back to its FIG. 2 orientation.

Figure 4:
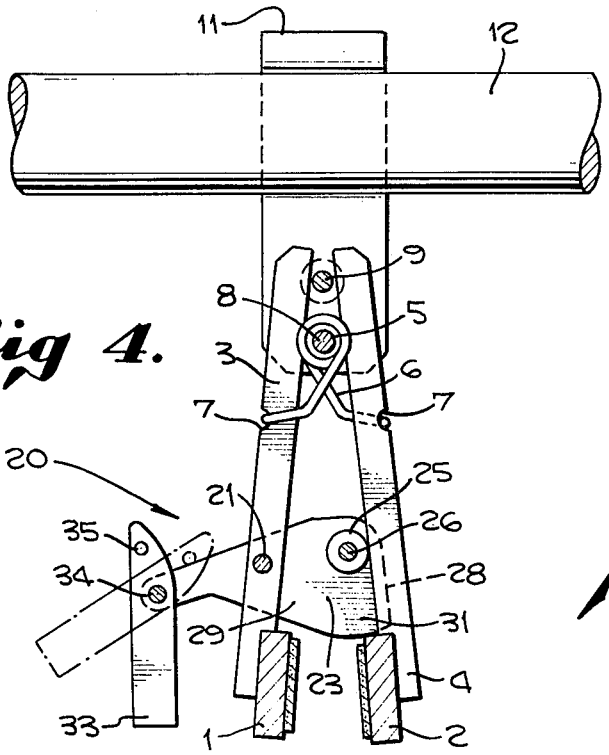
FIG. 4 is a view similar to FIG. 2 with the hanger in an open, unclamped orientation.
Figure 3:
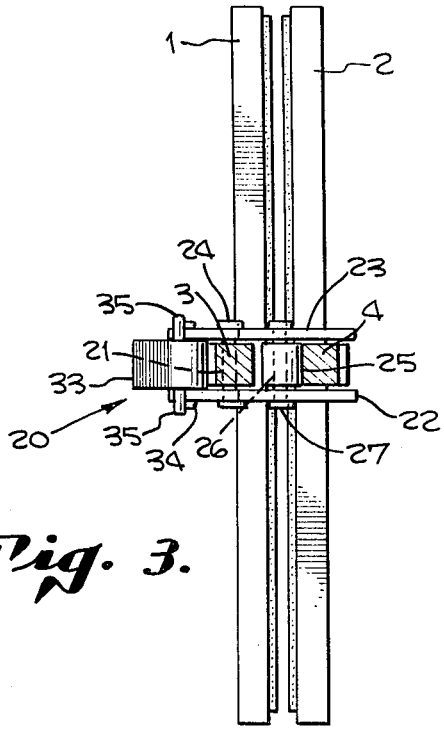
FIG. 3 is a sectional view of the clothing hanger taken through the plane III—III in FIG. 2.

Stop means on the hanger prevents movement of the camming means beyond the first position to retain the camming means at that position. The stop means sets the first position such that small forces on the camming means toward the second position moves the camming means a sufficient distance so that the other arm cams the camming means to its second position under urging of the spring. The stop means may be mounted on the camming means to engage one of the jaws when the camming means is in its first position. Turning especially to FIG. 4, the stop means includes a protuberance 31 on one or both camming plates. In the exemplary embodiment, the protuberance is on both camming plates. When the protuberance 31 engages the jaw 2, further pivoting in the clockwise direction (FIG. 4) is prevented. The dimensions of the protuberance 31 are chosen so that the roller 25 is in a slightly over-center position. That is, the result force from the arm 4 is directed below the cam pivot 21. Therefore, the force from arm 4 tends to pivot the camming means 20 in a clockwise direction. However, the dimension of the protuberance is chosen so that a slight force moving the protuberance off jaw 2 and moving the roller 26 upward so that the camming means is no longer past its over-center position, causes the force component from the arm 4 on the roller 25 to be directed above pivot 21. Therefore, the force from the arm 4 pivots the camming means 20 in a counterclockwise direction until the jaws 1 and 2 close and the camming means reaches its position shown in FIG. 2.

The stop means could also comprise a nub position on the inside wall of arm 4 which could prevent the roller 25 from rolling past it along the arm. The nub would be positioned at a location such that the roller would assume the configuration shown in FIG. 4. Conversely, an indentation could be made in the arm 4 which would prevent the roller from going beyond the configuration in FIG. 4. However, an indentation prevents the roller from moving upward under a small force.

The camming means may further comprise a handle on the camming means extending past one of the arms for being grasped by the user to cam the camming means. The handle means is hinged to the camming means for pivoting the handle means to prevent it from extending substantially from the hanger. The handle means in the exemplary embodiment is shown at 33 and is hinged at 34 between the camming plates 22 and 23. Stops 35 in the form of pins extending from the handle means 33 engage the camming plates to prevent rotation of the handle means beyond the configuration shown in FIG. 2 and the dotted configuration shown in FIG. 4. When it is desired to open the hanger, the handle 33 is grasped and urged in a clockwise direction. The weight of the handle causes it to rotate to a vertical position (FIG. 4) so that it does not extend outward substantially from the hanger in which position it would interfere with adjacent hangers or items of clothing.

Additionally, the camming plates have forward edges extending beyond the inside edge of arm 4 when the camming means is in its first position to prevent engaging clothing between the camming means and the inside edge of arm 3. As shown in FIG. 4, the camming plates 22 and 23 have a forward edge 28 extending beyond the inside edge of arm 4. When clothes are inserted between the jaws 1 and 2, material cannot locate itself between the forward edge 28 and the inside edge of arm 4 because the corner intersecting the side of protuberance 31 with the bottom of edge 28 is always beyond the inside wall of arm 4. Likewise, the bottom of the camming plate at location 29 rotates in a counterclockwise direction so that the camming plate cannot engage clothing between it and arm 3.

Resilient plates 10 and 11 are held against arms 3 and 4 by pins 8 and 9. The plates extend upward and are biased together. They are shaped to conform to the shape of closet hanger bar 12, and the resiliency of plates 10 and 11 holds the hanger on bar 12. Although the hanger of the present invention could use a conventional hook to hang from bar 12, the resilient plate embodiment resists the upward forces caused by pivoting handle 33 upward to open the jaws. If a handle is mounted on the roller end of cam means 20 instead of as shown in the exemplary embodiment, a hook would be preferred over the resilient plates because forces to open the jaws would be applied downward.

It will be understood that various modifications and changes may be made in the configuration described above which may come within the spirit of this invention, and all such changes and modifications coming within the scope of the appended claims are embraced thereby.

I claim:

1. In a clothing hanger having a pair of jaws and a pair of arms, each arm being connected to a jaw, said arms being pivotally mounted relative to each other whereby pivoting of the arms clamps and unclamps the jaws, biasing means for biasing the jaws to their clamped position and separating means for opening the jaws against the biasing means, the improvement in separating means comprising the provision of:

camming means movably mounted on one of said arms for camming engagement with the other of said arms during movement of the camming means between a first arm separating position and a second position allowing said biasing means to clamp the jaws, said camming means being pivotally mounted to said one of said arms for pivoting of the camming means between the first arm separating position and the second position, and stop means on the hanger for preventing movement of the camming means beyond the first arm separating position to retain the camming means in the first position and means for mounting said stop means in a position for setting the first position of the camming means such that small forces on the camming means toward the second position move the camming means a sufficient distance so that the other of said arms cams the camming means to its second position under urging from the biasing means.

2. The improvement of claim 1 wherein said camming means comprises a cam roller mounted on the end of said camming means engaging said other of said arms to reduce friction of the camming means on the other of said arms during movement of the camming means between the first and second positions.

3. The improvement of claim 2 wherein said other of said arms comprises a flat cam follower which said cam roller rolls on during movement of the camming means between the first and the second positions.

4. The improvement of claim wherein:
the means for mounting said stop means mounts the stop means on the camming means for engaging one of said jaws when the camming means is in its first position.

5. The improvement of claim 1 wherein:
said camming means comprises handle means on said camming means and extending past one of said arms for being grasped by a user to cam said camming means.

6. The improvement of claim 5 wherein:
said handle means comprises hinge means connecting said handle means to the camming means for pivoting the handle to prevent it from extending substantially from the hanger.

7. The improvement of claim 1 wherein said camming means comprises:
a. a pair of camming plates;
b. pivot means extending through said one of said arms for securing a camming plate on each side of said one of said arms;
c. cam roller means;
d. means for mounting the cam roller means between said camming plates for camming engagement with the other of said arms; and
e. stop means on the camming means comprising a protuberance on at least one of the camming plates for engaging a jaw to prevent the camming means from moving beyond the first position.

8. The improvement of claim 7 wherein said camming plates have forward edges extending beyond the inside edge of the other of said arms when the camming means is in its first position to prevent engaging clothing between the camming means and the inside edge of the other of the arms.

* * * * *

UNITED STATES PATENT AND TRADEMARK OFFICE

CERTIFICATE OF CORRECTION

PATENT NO. : 4,027,812

DATED : June 7, 1977

INVENTOR(S) : Harry G. Roseberg

It is certified that error appears in the above-identified patent and that said Letters Patent are hereby corrected as shown below:

Column 5, in Claim 4, line 1, insert - - 1 - - after "claim" and before "wherein".

Signed and Sealed this

*Eleventh* Day of *October 1977*

[SEAL]

*Attest:*

RUTH C. MASON
*Attesting Officer*

LUTRELLE F. PARKER
*Acting Commissioner of Patents and Trademarks*